United States Patent [19]

Maejima

[11] Patent Number: 4,978,314

[45] Date of Patent: Dec. 18, 1990

[54] WATERPROOF PRESS-CONNECTING CONNECTOR

[75] Inventor: Toshiro Maejima, Shizuoka, Japan

[73] Assignee: Yazaki Corporation, Tokyo, Japan

[21] Appl. No.: 439,742

[22] Filed: Nov. 21, 1989

[30] Foreign Application Priority Data

Nov. 24, 1988 [JP] Japan ..... 63-151851[U]
Nov. 24, 1988 [JP] Japan ..... 63-151852[U]

[51] Int. Cl.[5] ..... H01R 4/24

[52] U.S. Cl. ..... 439/398; 439/275; 439/417

[58] Field of Search ..... 439/271–283, 439/389–407, 409, 410, 411, 417–419

[56] References Cited

U.S. PATENT DOCUMENTS

| | | | |
|---|---|---|---|
| 4,435,034 | 3/1984 | Aujla et al. | 439/404 |
| 4,445,748 | 5/1984 | Evans | 439/271 |
| 4,512,619 | 4/1985 | Dechellette | 439/276 |
| 4,537,455 | 8/1985 | Vertenten et al. | 439/404 |
| 4,878,855 | 11/1989 | Heng et al. | 439/425 |

FOREIGN PATENT DOCUMENTS 3715529 10/1988 Fed. Rep. of Germany ..... 439/411

*Primary Examiner*—David L. Pirlot
*Attorney, Agent, or Firm*—Sughrue, Mion, Zinn, Macpeak & Seas

[57] ABSTRACT

A press-connecting connector of the waterproof type, comprising: a press-connecting connector housing including a cover portion which surrounds wire press-connecting portions in such a manner that the wire press-connecting portions are open in the direction of the press-connection; and a wire holder which comprises a seal member for fitting in the cover portion in a watertight manner; wire passing holes formed through the seal portion; wire holder members disposed in opposed relation to the corresponding wire press-connecting portions when the wire holder is fitted in said cover portion and wire retainer members for retaining the electric wires, passing through the wire passing holes, on the wire holder member, respectively.

4 Claims, 3 Drawing Sheets

WATERPROOF PRESS-CONNECTING CONNECTOR

BACKGROUND OF THE INVENTION

This invention relates generally to a press-connecting connector having press-connecting terminals, and particularly to a waterproof construction of a joint between the terminal and the electric wire.

A common method of waterproofing a joint between a terminal member of metal (which is received in a terminal receiving chamber of the connector) and an electric wire is to fit a waterproof plug (which is fitted on the electric wire) in an open portion provided at an axial rear end of the terminal receiving chamber.

However, in the type of connectors using press-connecting terminals, there are needed, in addition to such axial open portions, another open portions opening in the direction of the press-connection, so as to effect the press-connecting of the electric wires. Therefore, a large open portion, which is open in two directions (that is, in the axial direction of the press-connecting portion and in the direction of the press-connection), is provided at the end portion of each terminal receiving chamber to which the electric wire is to be connected. For this reason, the conventional waterproof plug can not be used.

A general technique for waterproofing such open portion has been proposed in Japanese Laid-Open (Kokai) Utility Model Application No. 57475/81, this technique being shown in FIG. 1. In this Figure, reference character a denotes a plug-in grip base, and electric wires b are connected to this base. Crimp-style terminals d, which are electrically connected respectively to terminals c on the lower surface of the plug-in grip base a, are fixedly secured to the plug-in grip base a. The upper portion of the plug-in grip base is partitioned by partition walls h for connection to the electric wire b, so that a plurality of recessed open portions e each opening in two directions are provided in juxtaposed relation to one another. A protective cap f of a rubber nature is of the same size as that of the recessed open portion e, and has a cavity for receiving the crimp-style terminal d therein. The protective cap f has a hollow chimney g through which the electric wire b is passed, and the protective cap is secured to the recessed open portion e by an adhesive or the like to thereby waterproof the joint. This technique is applicable to the connector of the type using press-connecting terminals if the crimp-style terminals d are replaced by the press-connecting terminals.

In the above conventional technique, however, the electric wires b must be passed respectively through the separate protective caps f one by one. Further, the protective caps f must be secured one by one to the respective recessed open portions e in which the crimp-style terminals d are arranged. This results in a problem that much time is required.

The present invention has been made in view of the above problems, and an object of the invention is to provide a press-connecting connector of the waterproof type which can use press-connecting terminals, and in which waterproof means can be easily attached to the connector.

SUMMARY OF THE INVENTION

To achieve the above object, the present invention provides a press-connecting connector of the waterproof type wherein press-connecting terminals are received respectively in terminal receiving chambers; and open portion is provided at one end portion of each terminal receiving chamber to which an electric wire is to be connected, said open portion being open both in an axial direction of a press-connecting portion and in a direction of the press connection;

CHARACTERIZED by the provision of: a seal member for closing said open portions in a watertight manner; a cover having a retainer mechanism for retaining said cover on said connector; small holes formed through said seal member so as to pass respectively the electric wires therethrough, each of said small hole being disposed in such a position as to close said press-connecting portion in the axial direction of the press-connecting portion; and slits each extending from the end of said seal member to a respective one of said small holes.

The above press-connecting connector is also characterized by the provision of: a seal member having an upstanding wall extending upwardly from bottom surfaces of the axial portions of said open portions, and having grooves formed in the distal end thereof for respectively receiving the electric wires; a seal member for closing said open portions in a watertight manner; and a cover having a retainer mechanism for retaining said cover on said connector; the distal end of said seal member being pressed against the distal end of said upstanding wall.

The electric wires are press-connected respectively to the press-connecting terminals of the press-connecting connector, and the cover is fitted on the connector from above. As the fitting of the cover proceeds, the electric wire reaches the small hole through the slit, so that the electric wire is held by the small hole in a watertight manner and is extended exteriorly of the connector. After the fitting of the cover is completed, the cover and the connector are retained with respect to each other by the retainer mechanism, and the two are held against each other in a watertight condition by the seal member.

According to another aspect of the invention, there is provided a press-connecting connector of the waterproof type, comprising: a press-connecting connector housing including a cover portion which surrounds wire press-connecting portions in such a manner that said wire press-connecting portions are open in the direction of the press-connection; and a wire holder which comprises a seal member for fitting in said cover portion in a watertight manner; wire passing holes formed through said seal portion; wire holder members disposed in opposed relation to the corresponding wire press-connecting portions when said wire holder is fitted in said cover portion and wire retainer members for retaining the electric wires, passing through said wire passing holes, on said wire holder members, respectively.

The press-connecting terminals are received in the press-connecting connector. The wire press-connecting portions are open in such a manner that they are surrounded by the cover portion. With respect to the holder for sealing the cover member, the electric wires are passed respectively through the wire passing holes, and are retained respectively on the wire holder members.

The holder is fitted in the cover portion of the press-connecting connector. As the fitting proceeds, each electric wire is pressed-fitted in the corresponding wire press-connecting portion by the wire holder member, thus connecting the electric wire and the press-connecting terminal together. As the fitting further proceeds, the seal member provided on the holder closes the cover portion in a watertight manner, thus completing the fitting operation.

PREFERRED EMBODIMENTS OF THE INVENTION

Figure 1:
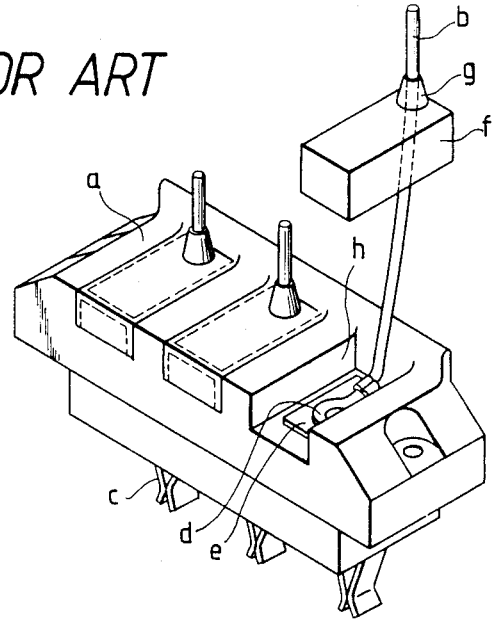
FIG. 1 PRIOR ART
FIG. 1 is a perspective view of a connector of the prior art.
Figure 2:
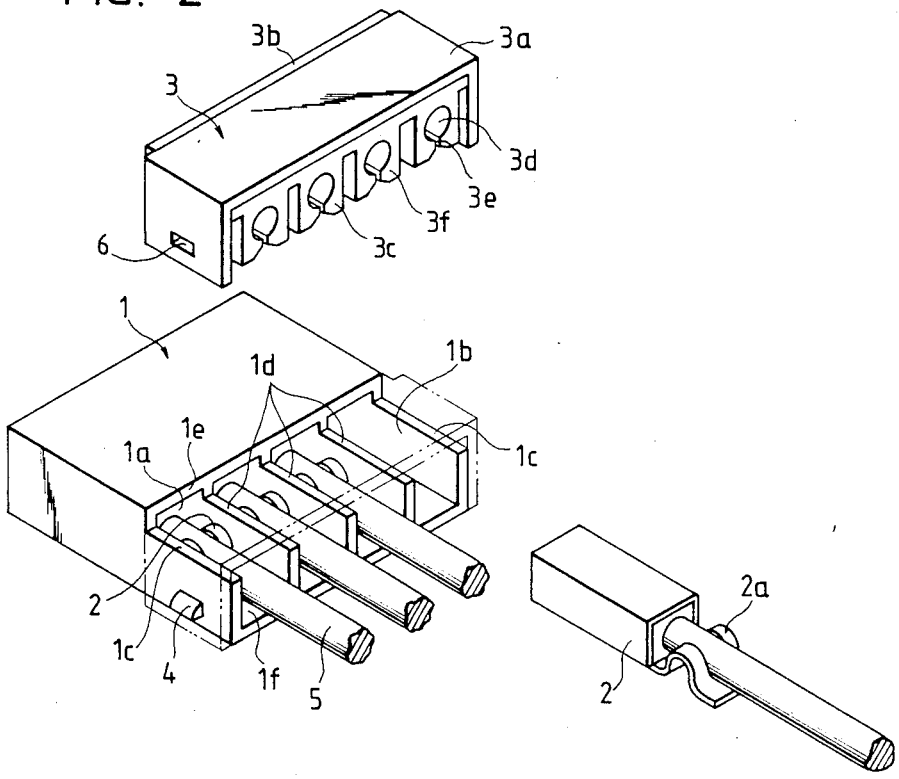
FIG. 2 is an exploded perspective view of a preferred embodiment of a waterproof-type press-connecting connector of the invention.

A first embodiment of the present invention will now be described with reference to FIG. 2. In FIG. 2, a connector housing 1 has a plurality of terminal receiving chamber 1*a* therein, and a press-connecting terminal 2 is received in each of the terminal receiving chamber 1*a*. An open portion 1*b* is provided at one end portion of each terminal receiving chamber 1*a* to which an electric wire 5 is to be connected, the open portion 1*b* being open in two directions, that is, in an axial direction of a press-connecting portion 2*a* and in the direction of the press connection disposed perpendicular to such axial direction. A projection serving as a retainer mechanism 4 is formed on the outer surface of each of the opposite side walls of the connector housing 1 at the one end portion thereof where the open portions 1*b* are provided.

A cover 3 serves to cover the open portions 1*b* and to waterproof the joints between the press-connecting portions 2*a* and the electric wires 5. The cover 3 comprises a body portion 3*a* and a seal member 3*b*. This single cover 3 is designed to entirely cover all of the open portions 1*b* of the connector housing 1. The cover body 3*a* comprises a plate member which covers those sections (upper sections in the drawings) of the open portions 1*b* in the direction of the press connection, the opposite end portions of the plate member being bent into contiguous relation to the outer surfaces of the opposite side walls of the connector housing 1, respectively. Retainer holes serving as a retainer mechanism 6 are formed respectively through the opposite bent portions and are disposed adjacent respectively to the distal ends of the bent portions. The seal member 3*b* is adapted to sealingly close the outer periphery of the open portions 1*b*. More specifically, the closing of the open portion 1*b* in the direction of the press-connection is effected by pressing the seal member 3*b* against the upper edges of the opposite side walls 1*c* of the connector housing 1, upper edges of partition walls 1*d* and an end surface 1*e* defining a rising surface of a step between the upper surface of the connector and the above walls 1*c* and 1*d*. The closing of the open portion 1*b* in the axial direction of the press-connecting portion is effected by inserting depending tongues 3*c* of the seal member 3*b* respectively into the open portions 1*b* in the direction of the press-connection and by pressing the tongues 3*c* against a bottom surface 1*f* of the connector housing 1, the opposite side walls 1*c* and the partition walls 1*d*. Each tongue 3*c* has a small hole 3*d* for the passage of the electric wire 5 therethrough, and a slit 3*e* extending from the small hole 3*d* to its distal end. That portion disposed at the inlet side of the slit 3*e* is slightly tapered as at 3*f* to facilitate the fitting of the electric wire 5. In this embodiment, the seal member 3*b* is made of oil-containing rubber, and therefore it provides a good sliding, so that the electric wire 5 can enter the slit 3*e* through the tapered portion 3*f* and be easily fitted into the small hole 3*d*.

The cover 3 may be formed entirely by a seal member of a rubber nature. Also, the tongues 3*c* may be separate from the seal member 3*b*.

The operation will now be described. First, the electric wire 5 is press-connected to the press-connecting terminal 2, received in each terminal receiving chamber 1*a*, from above. Then, the cover 3 is attached to the connector housing from above. As this attachment proceeds, each electric wire 5 enters the slit 3*e* of the corresponding tongue 3*c* through the tapered portion 3*f* and then reaches the small hole 3*d*. The small hole 3*d* is slightly smaller in diameter than the electric wire 5, and grips the electric wire 5 in a watertight manner. When the attachment of the cover 3 is completed, the retainer mechanisms 4 and 6 are engaged with each other, and the cover 3 is retained in such a manner that the cover 3 is pressed against the connector housing 1. As described above, the seal member 3*b* of a rubber nature including the tongues 3*c* is provided at that portion of the cover 3 for contact with the open portions 1*b*, and therefore the cover 3 is engaged with the connector housing 1 in a watertight manner. Further, when each tongue 3*c* is introduced into the corresponding open portion 1*b*, the tongue 3*c* undergoes compressive forces from its surroundings, so that the slit 3*e* and the tapered portion 3*f* are squeezed to be closed, thereby maintaining a watertight condition.

Figure 3:
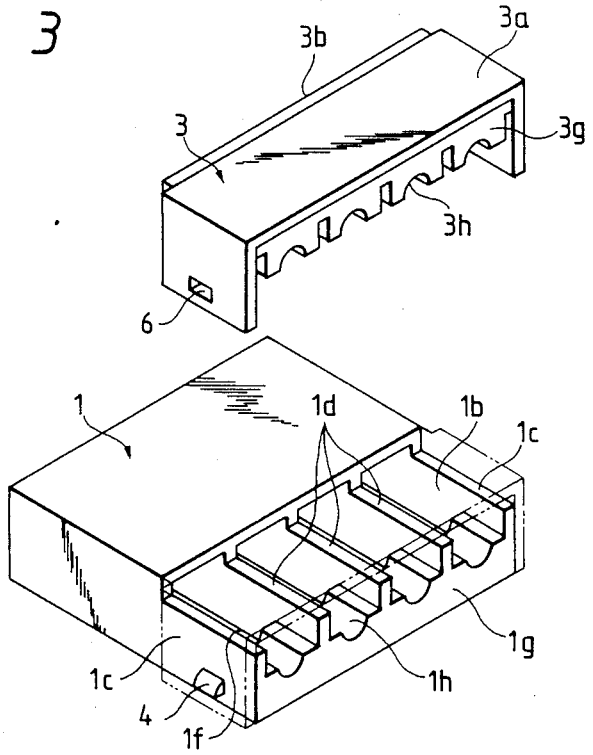
FIG. 3 is an exploded perspective view of another embodiment.
Figure 4:
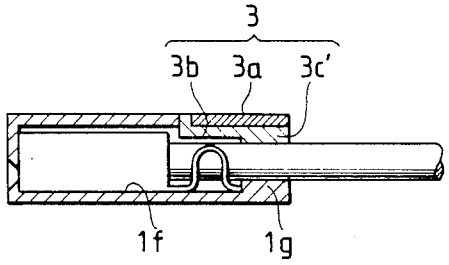
FIG. 4 is a vertical cross-sectional view of the embodiment of FIG. 3.

FIGS. 3 and 4 show a second preferred embodiment of the invention. This embodiment is generally similar to the preceding embodiment, and therefore only different parts will be described.

An upstanding wall 1*g* extending upwardly from a bottom surface 1*f* is provided at axial one ends of open portions 1*b* of a connector housing 1. Grooves 1*h* for receiving electric wires 5 are formed in the distal end of the upstanding wall 1*g*.

A seal member 3*b* of a cover 3 has depending tongues 3*g* which are pressed against the distal end of the upstanding wall 1*g* to close the open portion 1*b* in a watertight manner, as in the preceding embodiment of FIG. 2. The tongue 3*g* is shorter than the tongue 3*c* of FIG. 2, and has a length corresponding to a distance between the proximal end of the tongue 3*c* and the center of the small hole 3*d*. The tongue 3*g* has a groove 3*h* instead of the small hole 3*d*, and the groove 3*h* is disposed in opposed relation to the groove 1*h* of the upstanding wall 1*g* to hold the electric wire 5 watertight. FIG. 4 is a cross-sectional view of the connector housing 1 having the cover 3 retained thereon. With this construction, the slits 3*e* in FIG. 2 are unnecessary, and the waterproofness is enhanced, and the cover 3 can be manufactured more easily.

If the depth of the groove 1h in the upstanding wall 1g is suitably determined, the tongue 1g can be elastically deformed along the circumference of the electric wire to hold the same watertight, even if the tongue does not have the groove 3h. The attachment of the cover to the connector housing is simplified, and can be automated.

It is appreciated that, according to the present invention, the waterproofing that portion of the connector housing (using the press-connecting terminals) connected to the electric wires can be carried out easily, and the cost can be reduced. Further, the operation from the step of connecting the electric wires to the connector housing to the step of the waterproofing is simplified, and this operation can be automated. Further, the cover can also be manufactured easily, and the cost can be further reduced.

A third embodiment of the present invention will now be described with reference to FIGS. 5 and 6.

Figure 5:
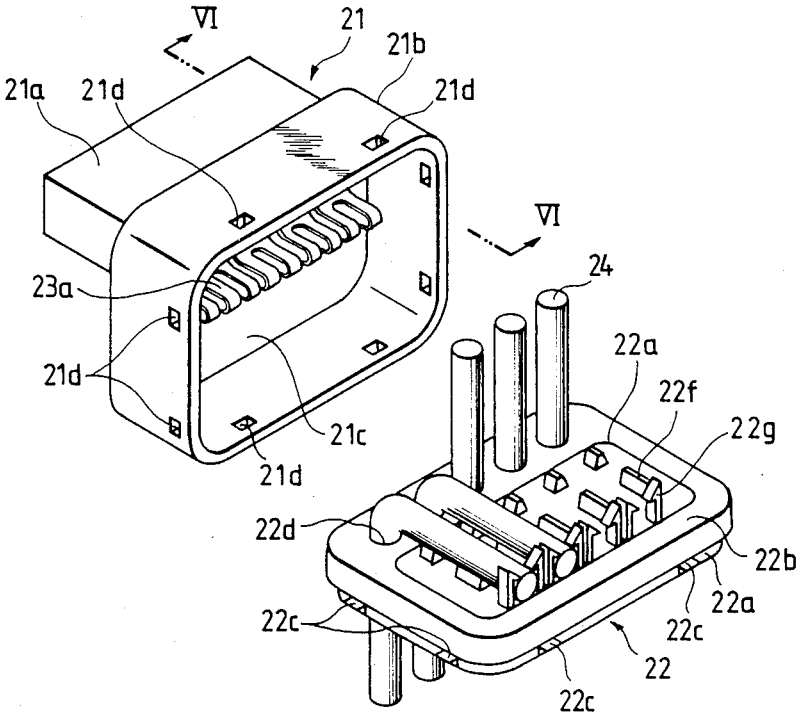
FIG. 5 is an exploded perspective view of a third embodiment of a waterproof-type press-connecting connector of the present invention.
Figure 6:
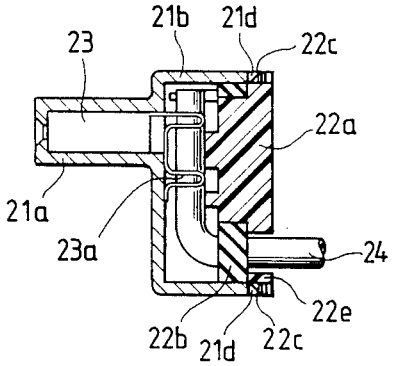
FIG. 6 is a cross-sectional view taken along the line VI—VI of FIG. 5.

In FIGS. 5 and 6, a connector housing 21 is adapted to fit on a wire holder 22 so as to effect the connection between press-connecting terminals and electric wires and also to waterproof the joints between them.

The connector housing 21 comprises a body portion 21a and a cover portion 21b. A plurality of press-connecting terminals 23 are received respectively in terminal receiving chambers (not shown) provided within the body portion 21a. Wire press-connecting portions 23a of press-connecting terminals 23 are bent at a rear end face 21c of the connector housing 21, and are surrounded by the cover portion 21b. More specifically, the cover portion 21b is open in the direction of press-connection of the press-connecting terminals, the rear end face 21c of the connector housing also serving as a bottom surface of the cover portion 21b. A plurality of retainer holes 21d are formed through the peripheral wall of the cover portion 21b, and are adapted to be engaged respectively with retainer projections 22c of the holder 22, as later described.

The holder 22 comprises a resin portion 22a and a seal member 22b of a rubber nature, and they are formed integrally with each other, for example, by injection molding or an adhesive. The resin portion 22a has a thickened section displaced with respect to the center, and a thinned section formed around the outer periphery of the thickened portion. The plurality of retainer projections 22c are formed on the outer periphery of the thinned section. The seal member 22b is provided on the resin portion 22a in such a manner that the seal member 22b covers the thinned section of the resin portion 22a. The seal member 22b is slightly greater in size than the opening or mouth of the cover portion 21b so as to close the cover portion 21b watertight. Wire passing holes 22d corresponding in number to the press-connecting terminals 23 are formed through the seal member 22b adjacent to one end thereof. The wire passing hole 22d is slightly smaller in diameter than the electric wire 24 so as to retain the electric wire 24 in a watertight manner. Slots 22e, etc., are formed through that portion of the resin portion 22a corresponding to the plurality of wire passing holes 22d, so as to enable the passage of the electric wires 24. Wire holder members 22f as well as wire retainer member 22g are formed on the thickened portion in corresponding relation to the press-connecting terminals 23.

The operation will now be described.

First, the electric wire 24 is passed through the wire passing hole 22d of the holder 22. The thus passed electric wire 24 is bent right-angularly to rest on the wire holder member 22f, with the distal end of the electric wire retained by the wire retainer member 22g. After all of the electric wires 24 are thus arranged in this manner, the holder 22 is fitted into the cover portion 21b. As the fitting of the holder 22 proceeds, each electric wire 24 are press-fitted by the respective wire holder members 22 to the corresponding press-connecting portions 23a to thereby connect the electric wire 24 and the corresponding press-connecting terminal 23a. As the fitting of the holder 22 further proceeds, the seal portion 22b closes the cover portion 21b in a watertight manner, and each retainer projection 22c is fitted in the corresponding retainer hole 21d to retain the holder on the connector housing 21, thus completing the fitting operation.

If the seal member 22b is thickened in the direction of the fitting and formed into a plug-like shape so as to close the mouth of the cover portion, the retainer projections 22c and the retainer holes 21d are unnecessary.

An described above, in the present invention, the wire press-connecting portions of the press-connecting connector can be sealed watertight simultaneously when the electric wires are press-connected respectively to the wire press-connecting portions. Thus, the assemblage of the connector can be carried out easily and efficiently, which enables the reduction of the cost. The assemblage is thus easy, and therefore can be automated.

I claim:

1. A press-connecting connector of the waterproof type wherein press-connecting terminals are received respectively in terminal receiving chambers; an open portion is provided at one end portion of each terminal receiving chamber to which an electric wire is to be connected, said open portion being open both in an axial direction of a press-connecting portion and in a direction of the press connection;

said press-connecting connector comprising: a seal member for closing said open portions in a watertight manner; a cover having a retainer mechanism for retaining said cover on said connector; small holes formed through said seal member so as to pass respectively the electric wires therethrough, each of said small holes being disposed in such a position as to close said press-connecting portion in the axial direction of the press-connecting portion; and slits each extending from an end of said seal member to a respective one of said small holes.

2. A press-connecting connector of the waterproof type wherein press-connecting terminals are received respectively in terminal receiving chambers; an open portion is provided at one end portion of each terminal receiving chamber to which an electric wire is to be connected, said open portion being open both in an axial direction of a press-connecting portion and in a direction of the press connection;

said press-connecting connector comprising: a first seal member having an upstanding wall extending upwardly from bottom surfaces of said open portions, and having grooves formed in a distal end thereof for respectively receiving the electric wires; a second seal member for closing said open portions in a watertight manner; and a cover having a retainer mechanism for retaining said cover on said connector; the distal end of said seal member being pressed against the distal end of said upstanding wall.

3. A press-connecting connector of the waterproof type, comprising:

a press-connecting connector housing including a cover portion which surrounds wire press-connecting portions in such a manner that said wire press-connecting portions are open in the direction of the press-connection; and a wire holder which comprises a holder retaining member and a seal member for fitting in said cover portion in a watertight manner; wire passing holes formed through said seal member; wire holder members, formed on said holder retaining member, disposed in opposed relation to the corresponding wire press-connecting portions when said wire holder is fitted in said cover portion; and wire retainer members, formed on said holder retaining member, for retaining the electric wires, passing through said wire passing holes, on said wire holder members, respectively.

4. A press-connecting connector of the waterproof type, as defined in claim 3, wherein said holder retaining member is formed of a resin material.

* * * * *